US007681886B2

(12) United States Patent
Morrow et al.

(10) Patent No.: US 7,681,886 B2
(45) Date of Patent: Mar. 23, 2010

(54) SHOOTING GALLERY DEVICES AND METHODS

(75) Inventors: Tim Morrow, Jefferson City, MO (US); Jacob Dale, Moberly, MO (US); Yan-Jiang Zhou, Columbia, MO (US); Tim Kinney, Columbia, MO (US); Dennis Cauley, Boonville, MO (US); Lucie Liang, Ballwin, MO (US); Russell A. Potterfield, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 11/679,136

(22) Filed: Feb. 26, 2007

(65) Prior Publication Data

US 2008/0023915 A1 Jan. 31, 2008

Related U.S. Application Data

(60) Provisional application No. 60/776,469, filed on Feb. 24, 2006.

(51) Int. Cl.
*F41J 9/00* (2006.01)

(52) U.S. Cl. ..... 273/366

(58) Field of Classification Search ..... 273/359, 273/366–370, 390–392, 406, 407
See application file for complete search history.

(56) References Cited

U.S. PATENT DOCUMENTS

| | | | | |
|---|---|---|---|---|
| 197,397 | A | 11/1877 | O'Neil | |
| 387,411 | A | 8/1888 | Gisel | |
| 399,604 | A | 3/1889 | Dufner et al. | |
| 499,315 | A | 6/1893 | Borchardt | |
| 568,543 | A | 9/1896 | Parks | |
| 668,219 | A * | 2/1901 | Rock | 273/366 |
| 691,912 | A | 1/1902 | McClean | |
| 718,865 | A * | 1/1903 | Northcraft | 273/366 |
| 778,865 | A | 1/1905 | Hyenga | |
| 789,909 | A * | 5/1905 | Herold | 273/366 |
| 1,033,624 | A | 7/1912 | Schmeisser | |

(Continued)

FOREIGN PATENT DOCUMENTS

| | | |
|---|---|---|
| DE | 838872 | 5/1952 |

(Continued)

OTHER PUBLICATIONS

U.S. Appl. No. 11/431,956, filed May 10, 2006, Morrow et al.

(Continued)

*Primary Examiner*—Mark S Graham
(74) *Attorney, Agent, or Firm*—Perkins Coie LLP

(57) ABSTRACT

Shooting gallery devices and methods are disclosed herein. In one embodiment, a shooting gallery includes a plurality of targets rotatably connected to a plurality of target connectors. The targets rotate between an extended position and a fallen position. The target and target connector assembly at least partially retains the targets in the extended position and/or prevents the targets from rotating from the extended position to the fallen position. Furthermore, the targets and target connector assemblies are configured to reset from the fallen position to the extended position without a rail guide or reset cam.

11 Claims, 10 Drawing Sheets

U.S. PATENT DOCUMENTS

| | | | | | |
|---|---|---|---|---|---|
| 1,061,577 | A | | 5/1913 | Whitney | |
| 1,088,362 | A | | 2/1914 | Perkins | |
| 1,089,307 | A | | 3/1914 | Benet et al. | |
| 1,121,945 | A | * | 12/1914 | Smith | 273/366 |
| 1,145,585 | A | | 7/1915 | Hebard | |
| 1,175,692 | A | | 3/1916 | Boicourt | |
| 1,187,325 | A | | 6/1916 | Ivey | |
| 1,195,777 | A | | 8/1916 | Burtin | |
| 1,250,215 | A | | 12/1917 | Panos | |
| 1,256,255 | A | | 2/1918 | Porter | |
| 1,295,688 | A | | 2/1919 | Butler | |
| 1,367,353 | A | | 2/1921 | Craig | |
| 1,488,647 | A | * | 4/1924 | Quinn | 273/368 |
| 1,639,722 | A | | 8/1927 | Whitney | |
| 1,693,289 | A | | 11/1928 | Warren | |
| 1,736,244 | A | | 11/1929 | Baker | |
| 1,902,040 | A | * | 3/1933 | Meyer | 273/356 |
| 1,907,181 | A | | 5/1933 | Fey | |
| 1,927,876 | A | * | 9/1933 | Meyer | 273/366 |
| 1,928,871 | A | | 10/1933 | Swebilius | |
| 2,066,218 | A | | 12/1936 | Morgan | |
| 2,079,510 | A | | 5/1937 | King et al. | |
| 2,090,930 | A | | 8/1937 | Chubb | |
| 2,100,514 | A | | 11/1937 | Miller | |
| 2,121,982 | A | | 6/1938 | Pugsley | |
| 2,125,353 | A | * | 8/1938 | Mattson | 273/366 |
| 2,216,766 | A | | 10/1940 | Cook | |
| 2,232,743 | A | * | 2/1941 | Swenson | 273/368 |
| 2,297,993 | A | | 10/1942 | Tratsch | |
| 2,331,372 | A | | 10/1943 | Buchanan | |
| 2,378,545 | A | | 6/1945 | Fraser et al. | |
| D147,305 | S | | 8/1947 | Sloan | |
| 2,432,519 | A | | 12/1947 | Garand | |
| 2,451,266 | A | | 10/1948 | Whittemore | |
| 2,455,644 | A | | 12/1948 | Barnes | |
| 2,476,078 | A | | 7/1949 | Banks | |
| 2,479,354 | A | | 8/1949 | Hanson | |
| 2,483,089 | A | | 9/1949 | Ferguson | |
| 2,484,801 | A | | 10/1949 | Anderson | |
| 2,508,951 | A | | 5/1950 | Kazimier | |
| 2,510,380 | A | | 6/1950 | Clifford | |
| 2,517,268 | A | | 8/1950 | Wilson | |
| 2,638,676 | A | | 5/1953 | Callahan | |
| 2,677,207 | A | | 5/1954 | Stewart | |
| 2,701,930 | A | | 2/1955 | Dolan | |
| 2,731,829 | A | | 1/1956 | Wigington et al. | |
| 2,740,530 | A | | 4/1956 | Ponder | |
| 2,753,642 | A | | 7/1956 | Sullivan | |
| 2,774,563 | A | | 12/1956 | Pribis | |
| 2,795,881 | A | | 6/1957 | Bellows | |
| 2,813,376 | A | | 11/1957 | Middlemark | |
| 2,817,233 | A | | 12/1957 | Dower et al. | |
| 2,821,117 | A | | 1/1958 | Hultgren | |
| 2,847,909 | A | | 8/1958 | Kester | |
| 2,867,931 | A | | 1/1959 | Schreiber | |
| 2,877,689 | A | | 3/1959 | Pribis | |
| 2,894,347 | A | | 7/1959 | Woodcock | |
| 2,924,881 | A | | 2/1960 | Gee | |
| 2,924,904 | A | | 2/1960 | Amsler | |
| 2,924,914 | A | | 2/1960 | Garwood | |
| 2,975,540 | A | | 3/1961 | Lewis | |
| 2,999,788 | A | | 9/1961 | Morgan | |
| 3,011,283 | A | | 12/1961 | Lunn et al. | |
| 3,012,350 | A | | 12/1961 | Wold | |
| 3,023,527 | A | | 3/1962 | Leek et al. | |
| 3,024,653 | A | | 3/1962 | Broadway | |
| 3,041,938 | A | | 7/1962 | Seabrook | |
| 3,055,655 | A | | 9/1962 | Chelf | |
| 3,060,612 | A | | 10/1962 | Brown et al. | |
| 3,112,567 | A | | 12/1963 | Flanagan | |
| 3,125,929 | A | | 3/1964 | Peasley | |
| 3,128,668 | A | | 4/1964 | Dicken | |
| 3,163,420 | A | * | 12/1964 | Braun | 273/366 |
| 3,175,456 | A | | 3/1965 | Goodsell | |
| 3,183,617 | A | | 5/1965 | Ruger et al. | |
| 3,206,885 | A | | 9/1965 | Dye | |
| 3,225,656 | A | | 12/1965 | Flaherty et al. | |
| D203,680 | S | | 2/1966 | Benchrest | |
| 3,240,103 | A | | 3/1966 | Lamont | |
| 3,259,986 | A | | 7/1966 | Carr | |
| 3,283,425 | A | | 11/1966 | Boyd | |
| 3,283,643 | A | | 11/1966 | Mittelsteadt | |
| 3,291,317 | A | | 12/1966 | Bowen | |
| 3,292,293 | A | | 12/1966 | Chiasera et al. | |
| 3,320,848 | A | | 5/1967 | Ponsness | |
| 3,323,246 | A | | 6/1967 | Loffler | |
| 3,327,422 | A | | 6/1967 | Harris | |
| 3,330,561 | A | | 7/1967 | Kandel | |
| 3,343,411 | A | | 9/1967 | Lee | |
| 3,353,827 | A | | 11/1967 | Dun, Jr. | |
| 3,370,852 | A | | 2/1968 | Kandel | |
| 3,406,969 | A | | 10/1968 | Tisdell et al. | |
| 3,423,092 | A | | 1/1969 | Kandel | |
| D215,311 | S | | 9/1969 | Born | |
| 3,486,752 | A | | 12/1969 | Colvin | |
| 3,499,525 | A | | 3/1970 | Kanter | |
| 3,510,951 | A | | 5/1970 | Dow | |
| 3,513,604 | A | | 5/1970 | Matsunaga et al. | |
| 3,550,941 | A | | 12/1970 | Spiro et al. | |
| 3,556,666 | A | | 1/1971 | Lichenstern | |
| D220,154 | S | | 3/1971 | Irelan | |
| 3,572,712 | A | | 3/1971 | Vick | |
| 3,580,127 | A | | 5/1971 | Lee | |
| 3,583,556 | A | | 6/1971 | Wagner | |
| 3,584,820 | A | | 6/1971 | Butcher, Sr. | |
| 3,587,193 | A | | 6/1971 | Lewis | |
| 3,608,225 | A | | 9/1971 | Manuel | |
| 3,680,266 | A | | 8/1972 | Shiplov | |
| 3,680,354 | A | | 8/1972 | Phillips, Jr. | |
| 3,711,955 | A | | 1/1973 | Holt | |
| 3,711,984 | A | | 1/1973 | Dyer et al. | |
| 3,739,515 | A | | 6/1973 | Koon, Jr. | |
| 3,744,292 | A | | 7/1973 | Michelson | |
| 3,745,875 | A | | 7/1973 | Kennedy et al. | |
| 3,748,950 | A | | 7/1973 | Huntington | |
| 3,764,219 | A | | 10/1973 | Collins | |
| 3,769,758 | A | | 11/1973 | McDonald | |
| 3,813,816 | A | | 6/1974 | Funk | |
| 3,815,270 | A | | 6/1974 | Pachmayr | |
| 3,826,559 | A | | 7/1974 | Berliner et al. | |
| 3,827,172 | A | | 8/1974 | Howe | |
| 3,842,527 | A | | 10/1974 | Low | |
| D233,853 | S | | 12/1974 | Ferrara | |
| 3,877,178 | A | | 4/1975 | Campanelli | |
| 3,885,357 | A | | 5/1975 | Hoyt | |
| 3,893,266 | A | | 7/1975 | Anderson et al. | |
| 3,895,803 | A | | 7/1975 | Loe | |
| 3,899,175 | A | | 8/1975 | Loe | |
| D237,106 | S | | 10/1975 | Baljet et al. | |
| 3,913,746 | A | | 10/1975 | Burton | |
| 3,914,879 | A | | 10/1975 | Taylor, Ill et al. | |
| 3,935,657 | A | | 2/1976 | Wade | |
| 3,947,988 | A | | 4/1976 | Besaw | |
| 3,949,987 | A | | 4/1976 | Candor | |
| 3,961,436 | A | | 6/1976 | Hagen et al. | |
| 3,964,613 | A | | 6/1976 | Anderson, Jr. | |
| 3,979,849 | A | | 9/1976 | Haskins | |
| 4,007,554 | A | | 2/1977 | Helmstadter | |
| 4,012,860 | A | | 3/1977 | Auger | |
| 4,021,971 | A | | 5/1977 | McFadden | |
| 4,026,057 | A | | 5/1977 | Cady | |
| 4,027,781 | A | | 6/1977 | Covert | |
| 4,042,242 | A | | 8/1977 | Nicholls et al. | |
| 4,054,288 | A | | 10/1977 | Perrine, Sr. | |

4,055,016 A 10/1977 Katsenes
4,072,313 A 2/1978 Murso et al.
4,076,247 A 2/1978 Kim et al.
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,358,254 A 10/1994 Yeh et al.
5,361,505 A 11/1994 Faughn 5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,044,747 A 4/2000 Felts
6,058,641 A 5/2000 Vecqueray
6,073,381 A 6/2000 Farrar et al.
6,086,375 A 7/2000 Legros
6,110,020 A 8/2000 Rolfi
6,121,556 A 9/2000 Cole
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,736,400 B1 * 5/2004 Cesternino ..... 273/366
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
D540,904 S 4/2007 Werner
7,207,567 B1 4/2007 Brown
7,225,050 B2 5/2007 Sutula, Jr.
D553,219 S 10/2007 Potterfield
D567,895 S 4/2008 Cauley
7,357,250 B2 4/2008 Hagemann et al.
7,363,740 B2 4/2008 Kincel
7,401,431 B2 7/2008 Pierce et al.
D576,245 S 9/2008 Potterfield et al.
7,426,800 B2 9/2008 Pierce et al.
2002/0113372 A1 8/2002 Love
2004/0020097 A1 2/2004 Deros
2004/0134113 A1 7/2004 Deros et al.
2005/0000141 A1 1/2005 Cauley et al.
2005/0011101 A1 1/2005 Gooder
2005/0115137 A1 6/2005 Minneman
2005/0183319 A1 8/2005 Franks

| | | | |
|---|---|---|---|
| 2005/0188597 | A1 | 9/2005 | Keng et al. |
| 2005/0242250 | A1 | 11/2005 | Keng et al. |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0068379 | A1 | 3/2007 | Sween et al. |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0295197 | A1 | 12/2007 | Potterfield |
| 2008/0023379 | A1 | 1/2008 | Potterfield et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0168697 | A1 | 7/2008 | Potterfield et al. |
| 2008/0174071 | A1 | 7/2008 | Potterfield et al. |
| 2009/0049731 | A1 | 2/2009 | Seuk |
| 2009/0056192 | A1 | 3/2009 | Oz |
| 2009/0064559 | A1 | 3/2009 | Potterfield et al. |
| 2009/0126250 | A1 | 5/2009 | Keng |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj ..., 3 pgs, the date on which The Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4 Targets.
Caldwell™ Shooting Supplies, Targets & Target Accessories, InstraView™ Targets, 1 page.
Californiavarmintcallers.com—Forum, http://californiavarmintcallers.com/community/modules/newbb/viewtopic.php?topic_id=10&foru m=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.

Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product #510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2, date unknown.
Caldwells lnsta-View 4" Targets, 1 page [product photo].
CV-500, 3 pages [product photos].
Dillon Precision CV-500 Cartridge Case Vibratory Cleaner, 6 pages [product photos].
Lyman Hornad Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual No. Ten for Rifle and Pistol," The Cartridge Components, SPEER Omark Industries, pp. 28-54.
"Shotshell reloading with a Grabber 76," MEC—Mayville Engineering Company, Inc., pp. 1-12.
Sweeney, P "Gunsmithing: Mesure Headspace," Peterson's Rifleshooter, http://www.rifleshootermag.com/gunsmithing/headspace_0612/, 4 pages [Internet Accessed Dec. 11, 2004].
Tenex Precision Co., "Recoil A-Rest-R," 4 pages, date unknown [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooter's Ridge, a division of ATK, and available at least by late 2005, 1 page.
"Uncle Bud's Udder Bag," http:www.unclebudscss.com/pages/Udder%20Bags.html, 2 pgs. [Internet accessed on Feb. 14, 2006].
"Uncle Bud's Bull Bags," http:www/unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id=..., 2 pages [Internet accesed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link,isp?id =0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages[Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/Iinks/Iink.jsp?id =0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/Iinks/Iink.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/ showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/Steady-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., I page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works . . , " http://www.eabco.com/TargetShooting01.htrnl, © 2007-2008, 1 page [Internet accessed Jul. 18, 2008].
MacksPW.com, "Desert Mountain Bench Master Rifle Rest," http://www.macksqw.com/Item—i—DESBM1, © 2004-2008, 1 page [Internet accessed Jul. 22, 2008].
Hyskore, "Rest—Dangerous Game Machine Rest," Hyskore Rest, Professional firearm rests, http://wwvv.hyskore.com/rests.htm, 2 page [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/ Shooting, http://hunting.about.com/od/reloadinfo/a/aaloademup_2htm, 6 page [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-_7gnY4CFRVNhgodjFhfSQ, 29 pages [Internet accessed on Aug. 30, 2007].
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 07, 2006, 8 pages.
Final Office Action; U.S. Appl. No. 10/865,595; Mailed on Apr. 3, 2007, 10 pages.
Non-Final Office Action; U.S. Appl. No. 11/339,863; Mailed on Sep. 23, 2008, 7 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Final Office Action; U.S. Appl. No. 11/271,100; Mailed on Sep. 22, 2008, 8 pages
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/679,100; Mailed on Oct. 16, 2008, 11 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
U.S. Appl. No. 12/276,223, filed Nov. 21, 2008, Potterfield et al.
U.S. Appl. No. 12/276,229, filed Nov. 21, 2008, Cauley et al.
U.S. Appl. No. 12/476,041, filed Jun. 1, 2009, Cauley.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 12 pagees.
Final Office Action; U.S. Appl. No. 11/339,863; Mailed on Mar. 10, 2009, 6 pages.
Final Office Action; U.S. Appl. No. 11/505,784; Mailed on Dec. 19, 2008, 10 pages.
Final Office Action; U.S. Appl. No. 11/679,100; Mailed on Aug. 3, 2009, 9 pages.
Final Office Action; U.S. Appl. No. 11/801,341; Mailed on Sep. 30, 2009, 6 pages.
Final Office Action; U.S. Appl. No. 11/853,763; Mailed on Jul. 13, 2009, 7 pages.
Non-Final Office Action; U.S. Appl. No. 11/206,430; Mailed on Jun. 23, 2009, 13 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.

Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/801,341; Mailed on Jan. 13, 2009, 7 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/117,668; Mailed on Aug. 13, 2009, 15 pages.
Non-Final Office Action; U.S. Appl. No. 12/209,113; Mailed on Sep. 23, 2009, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].

* cited by examiner

SHOOTING GALLERY DEVICES AND METHODS

CROSS REFERENCE TO RELATED APPLICATIONS

This application claims the benefit of U.S. Provisional Patent Application No. 60,776,469, filed Feb. 24, 2006, which is incorporated herein by reference.

TECHNICAL FIELD

The present disclosure is directed to shooting galleries and methods of operating shooting galleries.

BACKGROUND

Shooting galleries have existed for many years, providing amateurs and professionals alike the opportunity to shoot a firearm at a moving target for fun, skill, sport, enjoyment, and/or practice. Shooting galleries range from those found at amusement parks using numerous types of projectiles (water, cork, beans, BB's) to galleries designed for high power rifles. Conventional shooting galleries include multiple targets moving on an endless chain or belt in front of a shooter. As the targets pass laterally in front of a shooter, the shooter attempts to hit the targets with a projectile to knock the targets over. When a shooter successfully hits a target, the target temporarily disappears from view. The target then travels around a loop and reappears upright in front of the shooter. Most shooting galleries typically reset the targets by using a complex system including guides, reset cams and target rails to direct the targets upright again. One example of a shooting gallery device requiring a target rail to reset and retain the targets in an upright position along the target track is disclosed in U.S. Pat. No. 6,736,400 issued to Cesternino. These components increase the cost, complexity, size and weight of the gallery. Accordingly, a need exists to improve conventional shooting galleries.

DETAILED DESCRIPTION

A. Overview

Figure 1:
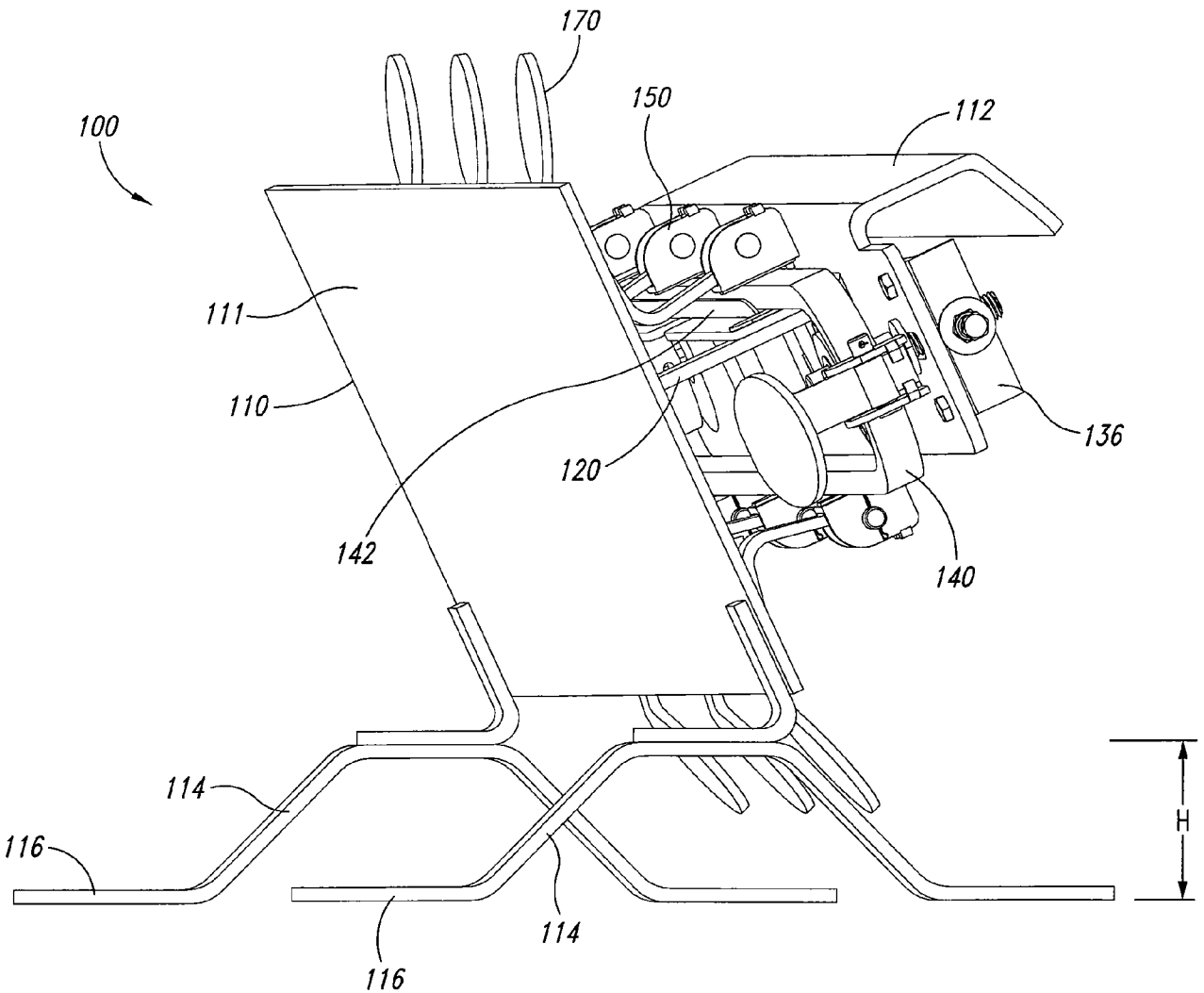
FIG. 1 is an isometric view of a shooting gallery in accordance with one embodiment of the invention.

The following disclosure describes several embodiments of shooting galleries. One aspect of the invention is directed to an automatic shooting gallery. In one embodiment, a shooting gallery comprises a first plate, a frame coupled to the first plate, a power source, and a conveyor driven by the power source. The conveyor travels in a predetermined path and includes a shooting zone and a return zone. A plurality of target connectors are coupled to the conveyor. The shooting gallery further comprises a plurality of targets that are movable between an extended position and a fallen position. The targets are pivotally connected to the target connectors, and the target connectors at least partially retain the targets in the extended position when the targets are positioned in the shooting zone. The targets at least partially rest against the target connectors in the extended position during the shooting zone of the path. The targets in the fallen position are configured to reset to the extended position from the fallen position during the return zone of the path without the aid of a resetting mechanism.

In another embodiment, the shooting gallery comprises a support frame, one or more gears rotatably coupled to the frame, a power source coupled to the one or more gears, and a conveyor disposed on the one or more gears. The power source drives the conveyor through a loop including a shooting zone and a return zone. The shooting gallery further includes a plurality of target connectors coupled to the conveyor and a plurality of targets retained by the target connectors. In another embodiment, the individual targets include a sleeve portion that removably and pivotally couples the targets to the individual target connectors. The targets are configured to pivot between extended and fallen positions, and to move laterally across the shooting gallery in a first direction through the shooting zone and in a second direction opposite the first direction through the return zone.

In another embodiment, the shooting gallery includes a target connector assembly including a target having a first portion and a target connector including side portions. The side portions can have an aperture configured to removably receive a pivot member. The first portion of the target is pivotally coupled to the pivot member. The assembly may be configured to increase the force required to pivot the target from an extended position to a fallen position.

In another embodiment, the shooting gallery includes a target connector assembly having a first portion that slidably engages a target connector retention guide rail that is mounted to a support member on the shooting gallery. The target connector may be configured so that the targets do not touch the target connector retention guide rail when they are in the extended position.

Another embodiment of the invention is directed to a method of moving targets across a shooting gallery. The method comprises driving a conveyor with a power source through a cycle having a shooting phase and a return phase, wherein a plurality of target connectors are attached to the conveyor. The method further comprises pivotally connecting individual targets to the plurality of target connectors and moving the targets laterally across the shooting gallery in a first direction during the shooting phase. The targets move in the first direction and rotate between an extended position and a fallen position. The method further comprises moving the targets in a second direction opposite the first direction laterally across the shooting gallery during the return phase. In the return phase targets in the fallen position automatically reset to the extended position without the aid of a resetting device.

Another embodiment of the invention includes a method of connecting a plurality of targets to a shooting gallery. The method comprises attaching a plurality of target connectors to a conveyor that travels in a loop relative to the shooting gallery and pivotally coupling a target to each of the target connectors with a removable pin. The pin is inserted through a sleeve portion of the targets such that the targets rotate about the pin between an extended position and a fallen position. The targets automatically reset from the fallen position to the extended position without contacting any other device.

Specific details of several embodiments of the invention are described below with reference to shooting galleries and shooting gallery assemblies. Several details describing well-known structures or processes often associated with shooting galleries are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-5.

B. Embodiments of Shooting Galleries

FIG. 1 is an isometric view of a shooting gallery system 100 in accordance with one embodiment of the invention. In this embodiment, the system 100 includes a first plate 110 attached by attachment means 115 to feet 114 and a support frame 120. The first plate 110 protects other components of the system 100 from projectiles fired at the system 100. For example, the first plate 110 is made of a material, such as steel, that can sufficiently withstand a varied caliber of projectiles. The first plate 110 includes a first side 111 that is slightly angled downward to deflect projectiles that strike the first plate 110 toward the ground. In other embodiments, the first plate 110 may include a receptacle (not shown) to catch or collect the deflected projectiles. The feet 114 also include elongated members 116 to provide a stable base for the system 100 to at least partially prevent the system from moving or falling when a projectile strikes the first plate 110. Alternatively, the feet 114 may include spiked or pointed ends (not shown) to facilitate embedding the feet 114 into the ground. The feet 114 have height H to space the system 100 away from the ground. According to alternative embodiments, the feet 114 are removable so that the system 100 is lighter and less bulky to transport. According to other alternative embodiments, the feet attach directly to plate 110 or support frame 120 without attachment means 115.

According to one embodiment, the support frame 120 is connected to a power source 130 (shown in FIG. 2B) that drives a conveyer 140. The conveyor 140 is a flexible conveyer that travels around the system 100 in an endless loop along a predefined path, as explained below regarding FIGS. 2A-C. In some embodiments, the conveyer 140 is mounted so that a plane bisecting the conveyer's longest axis is not perpendicular to a horizontal plane. In the embodiment illustrated in FIG. 1, the conveyor is a belt; however, in other embodiments the conveyor may comprise a wire, strap, cable, chain (e.g., a linked chain or roller chain), or any other device suitable for traveling around the system 100. The conveyor 140 travels over one or more gears (not shown) coupled to a tension device 136 attached to the frame 120. The tension device 136 is configured to adjust a tension in the conveyor 140. For example, as illustrated in FIG. 2B, the tension device 136 includes a set screw 137 that can increase or decrease the tension of the conveyor 140. Referring again to FIG. 1, the system 100 further includes a plurality of target connectors 150 attached to the conveyor 140. The target connectors 150 can be brackets, hinges, magnetic couplings, or mechanical or electromechanical connection means as are known in the art. One embodiment of the target connectors 150 are described in more detail below with respect to FIGS. 3A-B. Individual target connectors 150 rotatably and removeably connect to individual targets 170 to move the targets along the predefined path of the conveyor 140.

Figure 2A:
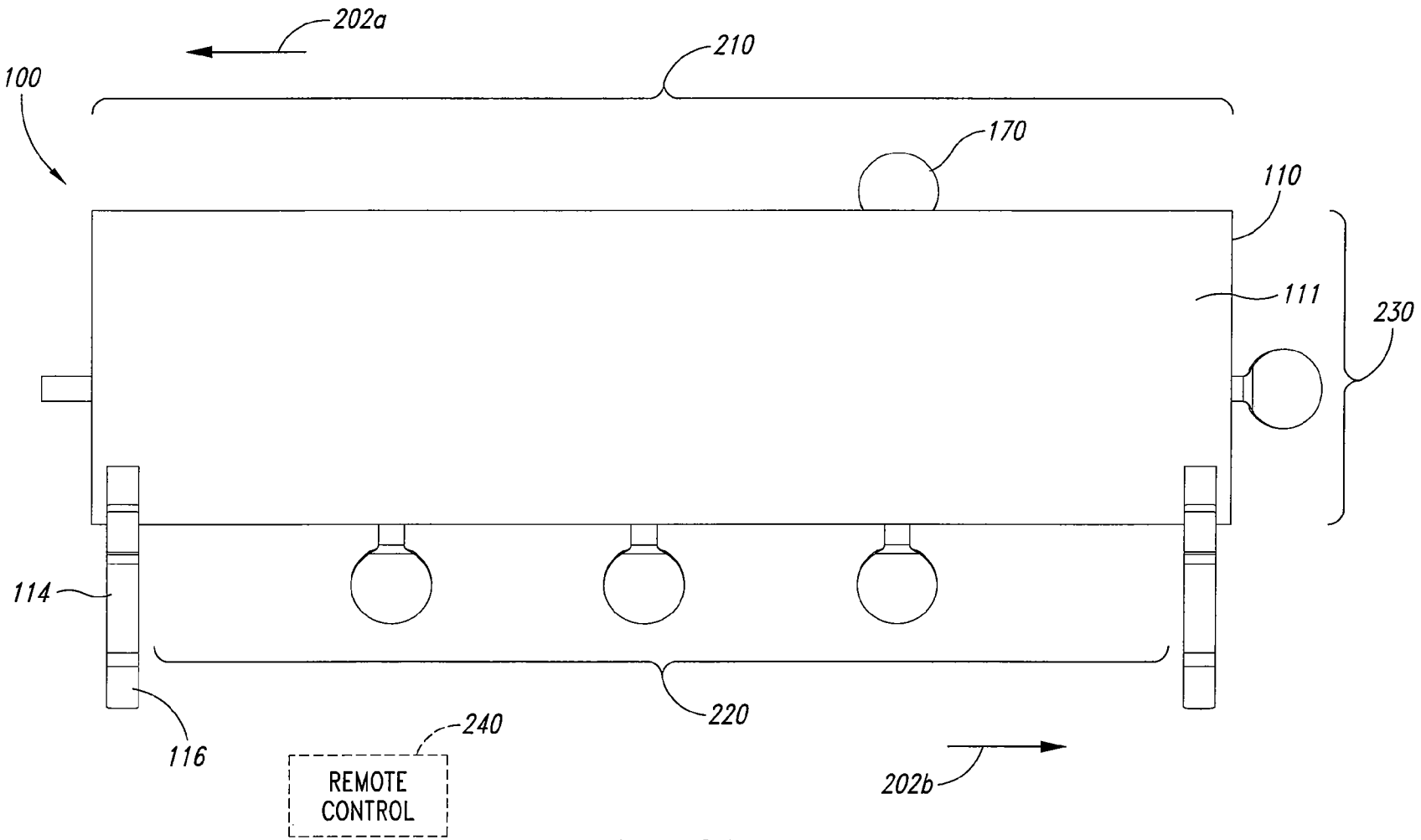
FIG. 2A is a schematic front view.
Figure 2B:
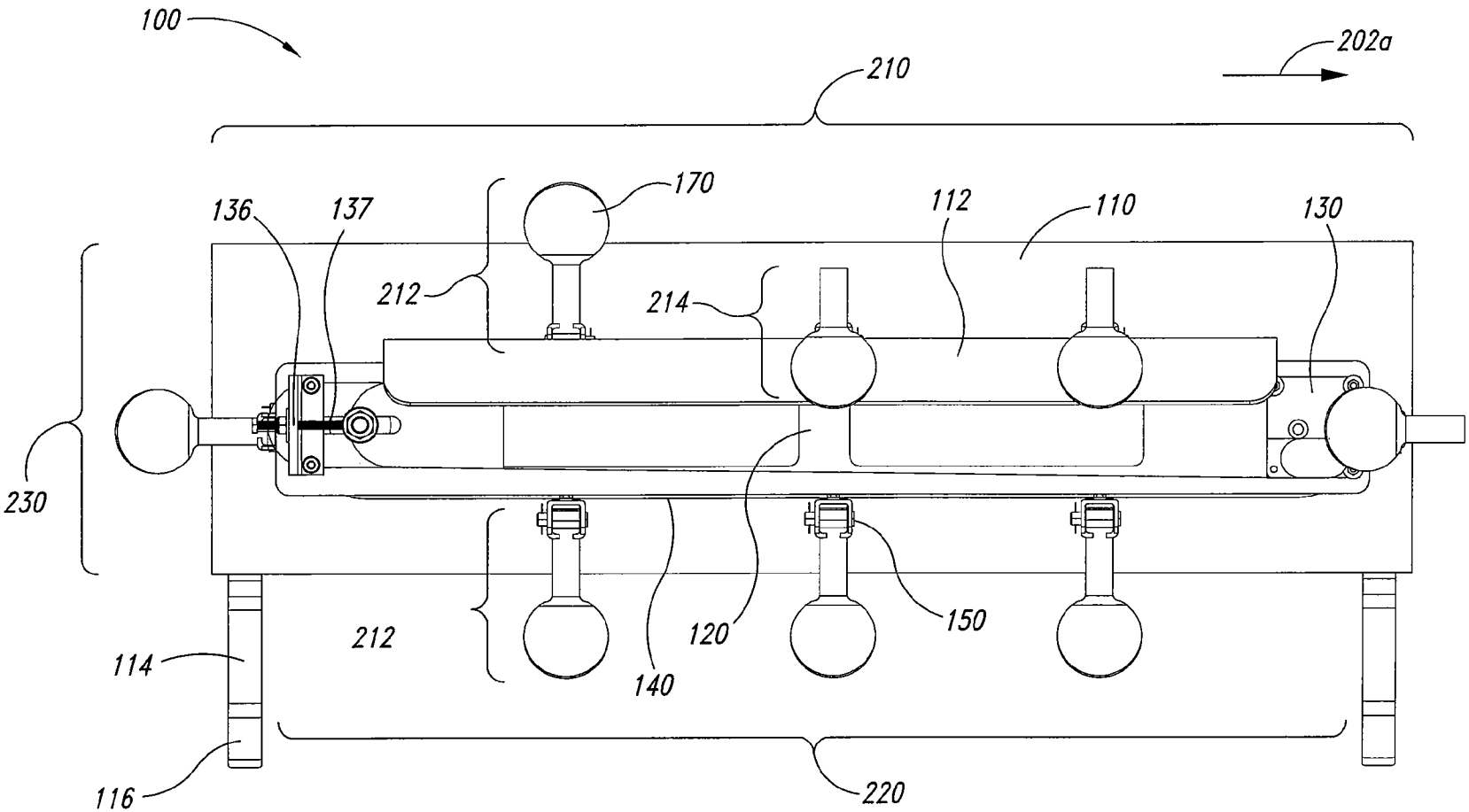
FIG. 2B is a schematic back view.
Figure 2C:
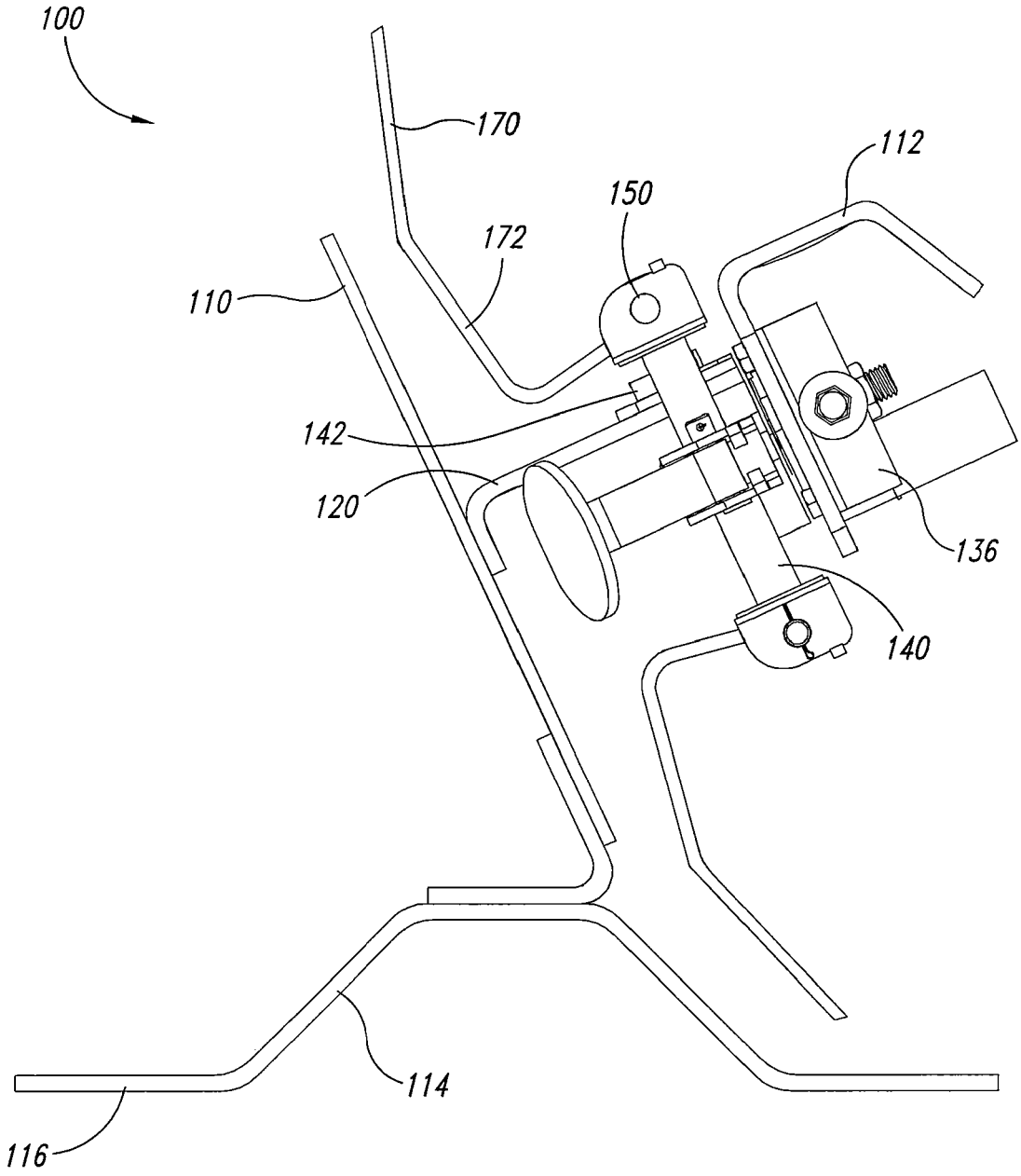
FIG. 2C is a schematic side view of a shooting gallery in accordance with an embodiment of the invention.

FIG. 2A is a schematic front view, FIG. 2B is a schematic back view, and FIG. 2C is a schematic side view of an embodiment of the shooting gallery system 100. Like reference characters refer to like components in FIGS. 2A-C and FIG. 1, and thus the description of such components will not be repeated with reference to FIGS. 2A-C. The difference between FIG. 1 and FIGS. 2A and 2B is that a few of the targets 170 are rotated into a second or fallen position 214. Referring to FIGS. 2A-D, the conveyor 140 moves the target connectors 150 and in turn moves the targets 170 laterally across the system 100 in a first direction 202*a* in the active zone 210 of the conveyor travel and in a second direction 202*b* opposite the first direction 202*a* in a return zone 220 of the conveyor travel. When a target is in the active zone 210 of the conveyor travel, the targets 170 are in a first or extended position 212 such that at least a portion of each target 170 is visible to the shooter when viewing the system 100 from the first side 111. When the shooter fires a projectile and successfully hits a target 170 contained in the active zone 210, the target 170 rotates to the fallen position 214 out of view of the shooter. In the fallen position 214, the targets 170 continue to travel with the conveyor 140 to the return zone 220 of the conveyor travel.

In the return zone 220, gravity maintains the targets in the extended position 212 if not knocked down in the active zone 210. Alternatively, gravity aids in rotating and resetting the targets 170 from the fallen position 214 to the extended position 212 if the targets 170 were knocked down while in the active zone. When rotating in the return zone 220, the targets 170 automatically rotate from the fallen position 214.to the extended position 212. Thus, gravity provides a sufficient force to rotate the targets 170 into a vertical position. In addition, the geometry of the targets 170, which according to embodiments of the invention, provides an eccentric weight over center; the configuration of the target connectors 150; and/or the targets 170, helps in rotating the targets 170 from the fallen position 214 to the extended position 212 without the aid of a target rail or a resetting cam. For example, as illustrated in FIG. 2C, a support portion 172 of the targets 170 is generally parallel with the first plate 110 such that the targets 170 tend to pivot toward the first plate 110 from the fallen position 214 to the extended position 212 in the return zone 220 and also in the active zone 210. In some embodiments, additional weight (not shown) may be attached to the support portion to increase the tendency for the target to assume the extended position.

In operation, the targets 170 travel through a transition zone 230 from the return zone 220 to the active zone 210 in the loop. Because the targets 170 have automatically righted themselves to the extended position 212 in the return zone 220, the targets 170 enter the transition zone 230 in the extended position 212 and travel through the transition zone 230 in the extended position 212. Accordingly, no guide rail, target rail, reset cam or other reset surface or other structure contacting the targets 170 is necessary to reset the targets 170 from the fallen position 214 to the extended position 212.

Furthermore, as illustrated in FIG. 2C, the targets 170 are configured to travel through the active zone 210 without a support or contact member contacting the support portion 172 of the targets 170 while in the extended position 212.

Eliminating the need for contact surfaces or structures to reset or support the targets reduces the complexity of the system 100. For example, as described in more detail below, the target connector 150 and target 170 are configured to support the target in both the extended position 212 and the fallen position 214 without requiring contact from other structures or devices. Accordingly, the need is eliminated for contact structures to reset the targets 170 between fallen positions 214 and extended positions 212 or a guide rail or other structure to support the targets 170 as the targets 170 advance through in the active zone 210 results in fewer components of the system. In addition, this configuration reduces the cost and weight of the system 100.

In certain embodiments, the system 100 can further include a wireless remote control unit 240 for controlling the movement of the targets 170 in the system 100. In other embodiments the remote control may be electrically connected to the power source 130 with a wire (not shown) of sufficient length (e.g., 40 feet in a specific embodiment) to provide a safe shooting distance. The remote control 240 can direct the speed and direction of the target 170 movement by controlling the speed and direction of the conveyer 140. For example, the remote control 240 can include a rheostat or potentiometer for speed adjustment. The remote control 240 can also be configured to vary the target speed from a maximum to a minimum over a period of time, such as periods of three seconds in a specific example. The remote control 240 can also be configured to periodically stop the targets from moving. Accordingly, the controller allows a user to adjust the target travel speed according to personal preferences from a safe distance while also providing a dynamic target shooting experience. In alternative embodiments, no remote control is provided and the shooting gallery 100 is operated by a power switch (not shown) contained on the system.

According to alternative embodiments, the system 100 also includes a conveyor guide 142 positioned proximate to the conveyor 140. When the targets 170 rotate from the extended position 212 to the fallen position 214, the targets 170 may cause the conveyor 140 to twist. Accordingly, the conveyor guide 142 can provide support to at least partially prevent the conveyor 140 from twisting.

Figure 2D:
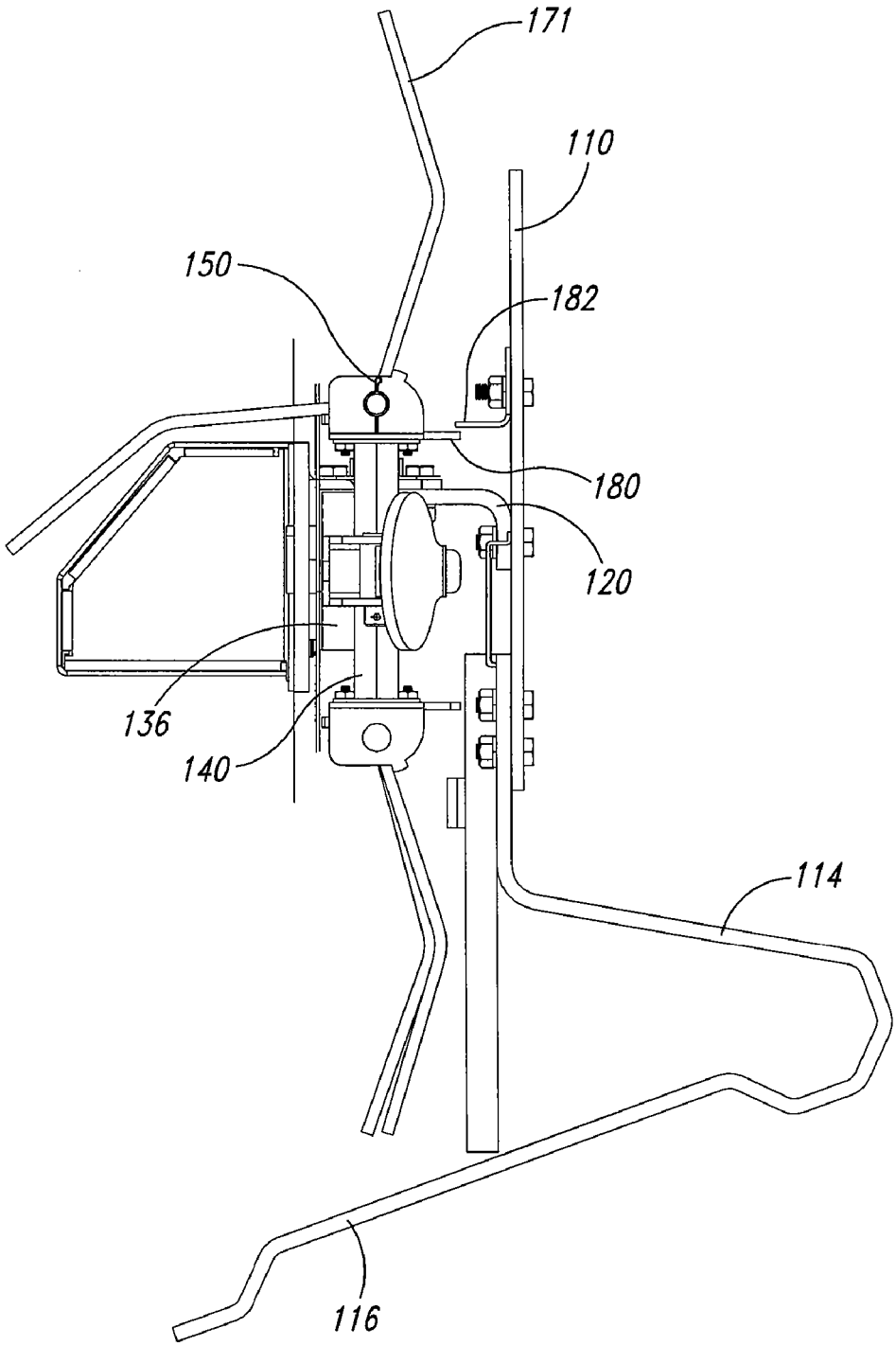
FIG. 2D is a schematic side view of a shooting gallery in accordance with another embodiment of the invention.

As shown in FIG. 2D, an integral target connector retaining means retention guide 180 is slideably engaged under retention device 182 when the targets 170 are in the active zone 210. The rentention device 182 may include a bracket, angle tab or other mechanical or electromechanical retention device. In operation, retention device 182 prevents the conveyor from twisting during projectile impact. As further shown in FIG. 2D, the feet 114 can be configured in any stabilizing geometric configuration including but not limited to those shown in the drawings.

C. Target and Target Connector Configuration Embodiments

Figure 3A:
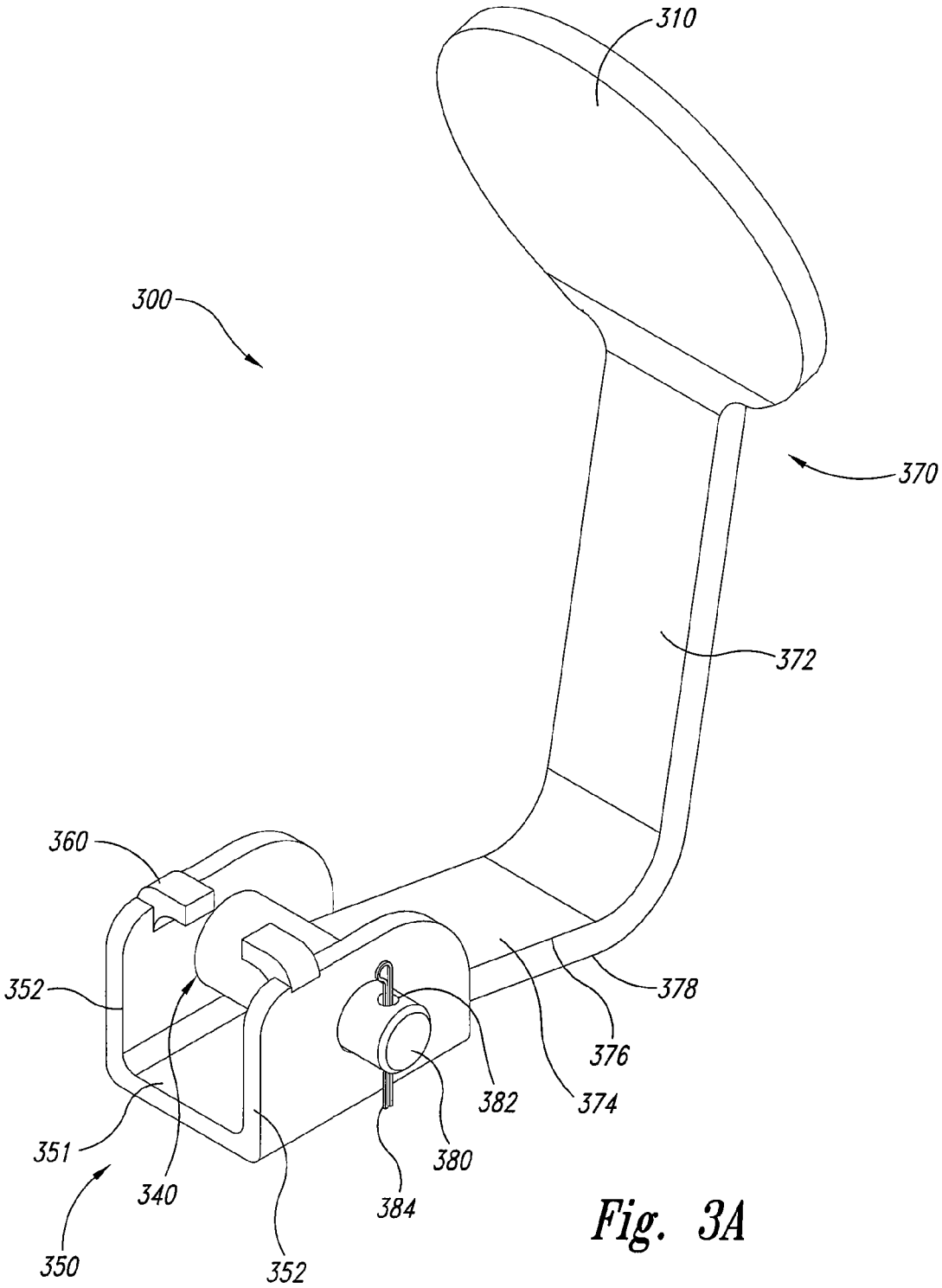
FIG. 3A is an isometric view of a target and target connector assembly.

FIG. 3A is a schematic isometric view of an assembly 300, including a target 370 and target connector 350 in accordance with an embodiment of the invention. The assembly 300 includes a target 370 pivotally connected to a target connector 350. In one embodiment, the target 370 includes a target head 310, upper portion 372, and lower portion 374. The lower portion 374 includes an upper surface 376 and a lower surface 378. The target 370 can be formed of a single piece of material suitable for being shot with guns of varied calibers. For example, the targets 370 can be formed of a single piece of hardened steel. The target 370 may also be formed from several pieces of material. In certain embodiments, the target head 310 may include many different sizes and shapes. For example, as illustrated in FIG. 3A, the target head 310 may include a generally round shape. One skilled in the art will appreciate that other target head 310 shapes may be used, such as animal shapes, face card symbols, bull's-eyes, stars or other geometric shapes.

Figure 3B:
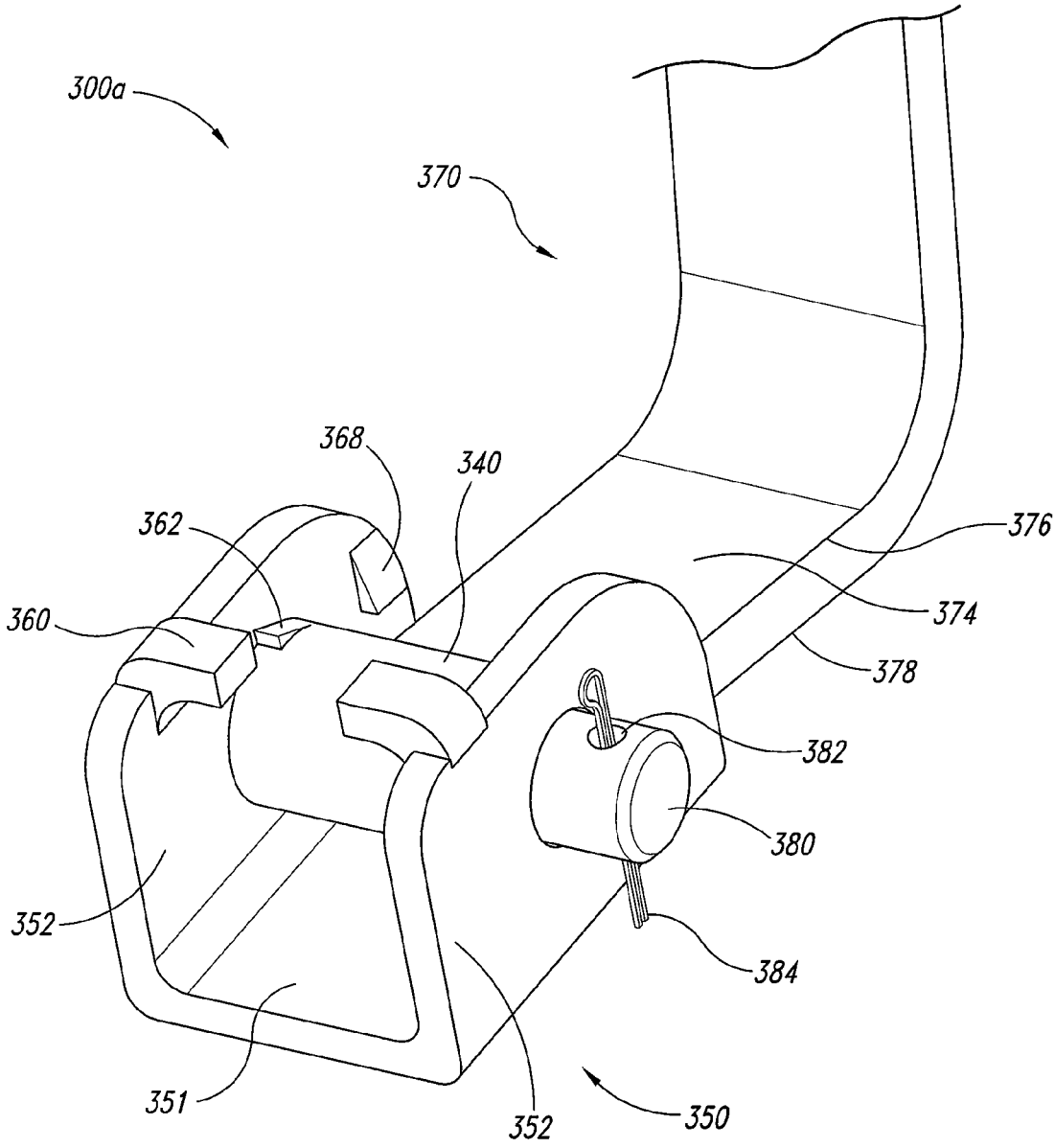
FIG. 3B is an isometric view of an alternative embodiment of the target.

The target 370 has a plurality of bends between the target head 310, upper portion 372, and lower portion 374, creating a geometry that at least partially assists the target 370 in pivoting from the fallen position to the extended position without the use of any other contact device, as described above. Moreover, the geometry of the target 370 also allows the target head 310 to be oriented generally perpendicular to a projectile source, such as a gun. As shown in FIG. 3B, target 371 may also be formed with a single bend. According to the illustrated embodiment, the target 370 consists of a tubular base portion 380, a target head 310 and a lower portion 372. Alternatively, the target may include a plurality of bends, no bends, a curved and/or straight configuration.

The target 370 is rotatably connected to the target connector 350 to rotate between the extended and fallen positions 212 and 214 described above. According to one embodiment, the target connector 350 includes a bottom surface 351 and sidewalls 352. The sidewalls 352 are spaced apart to allow at least part of the lower portion 374 of the target 370 to rotate between the sidewalls 352. The target connector 350 further includes an aperture 354 in each sidewall 352 to removably receive a pin 380. The pin 380 is inserted through a hollow portion, such as a sleeve 340 or ring of the target 370, to allow the target 370 to rotate about the pin 380 between the extended position and the fallen position. The sleeve 340, lower portion 372, upper portion 374 and target 370 may be integrally formed. Alternatively, the sleeve 340, lower portion 372, upper portion 374 and target 370 may be mechanically fixed together or may be a combination of integral and mechanically fixed.

The pin or tubular portion 380 includes an aperture 382 for inserting a removable retaining member 384, such as a cotter pin, for example. According to alternative embodiments, the target connector 350 also includes a stop 360 to restrict the rotation of the target 370 from the extended position to the fallen position. In certain embodiments, the stop 360 may be integral with the target connector 350, or the stop 360 may be attached to the target connector 350. In certain embodiments, the stop 360 can be located in a manner so as to restrict the rotation of the target 370 from the fallen position to the extended position. In certain embodiments, a stop 360 may be in both positions. As illustrated in FIG. 3A, in the extended position the lower surface 378 of the target 370 rests against the bottom surface 351 of the target connector 350. As the target 370 rotates to the fallen position, the upper surface 376 of the lower portion 374 rests against the stop 360. As the target 370 rotates to the fallen position, the upper surface 376 will contact the stop 360, thus halting the rotation of the target 370. Accordingly, the target 370 is configured to at least partially rotate about the pin 380 inserted into the target connector 350 between the extended and fallen positions 212 and 214. According to alternative embodiments, the target connector 350 can be a bracket, hinge, magnetic coupling, and/or other mechanical or electromechanical connection means.

According to aspects of the embodiment, the configuration of the target 370 and the target connector 350 provides many improvements, offering shooters a variety of advantages over existing shooting galleries. For example, the configuration of the target connectors 350 allows a shooter to change and replace targets as the targets become worn or bent. Moreover, a shooter can change or replace a target without using a tool because the retaining member 384 keeping the pin 380 in the sleeve 340 is easily removable. In addition, a shooter may replace targets with a preferred shape or combine different shapes together, thereby adding variability to the target selection. Furthermore, the configuration of the target 370 and target connector 350 eliminates the need for a contact member or rail to support the target 370 in the extended position during the shooting phase of the conveyor travel or to reset the target from the return phase to the shooting phase.

In certain embodiments, a second plate 112 illustrated in FIGS. 1 and 2B-C supplements the stop 360 in restricting the rotation of the target in the fallen position. For example, referring to FIGS. 1, 2B-C, and 3A, in the fallen position, the upper portion 372 of the targets 370 may contact and rest against the second plate 112, in addition to or in lieu of the stop 360, while the targets 370 move through the active zone 210 in the fallen position. One advantage of the second plate 112 is that the second plate 112 protects the other components of the system from stray projectiles or fragments from projectiles. In addition, as the targets are repeatedly struck with projectiles, the upper portion 372 or target head 310 can bend or deform. As a deformed target travels through the active zone 210 in the fallen position, the second plate 112 protects components of the system and prevents deformed targets from contacting or damaging the components of the system. Furthermore, the second plate 112 can further stabilize the conveyor 140 when a target moves from the extended position to the fallen position. For example, as the stop 360 of the target connector 350 stops the target 370 from rotating, the force of the rotating target 370 can cause the conveyor 140 to twist or move. This twisting motion occasionally causes other targets 370 not struck by a projectile to rotate to the fallen position. Accordingly, at least partially supporting the targets 370 with the second plate 112 in the fallen position helps prevent the conveyor 140 from twisting or moving.

Figure 3C:
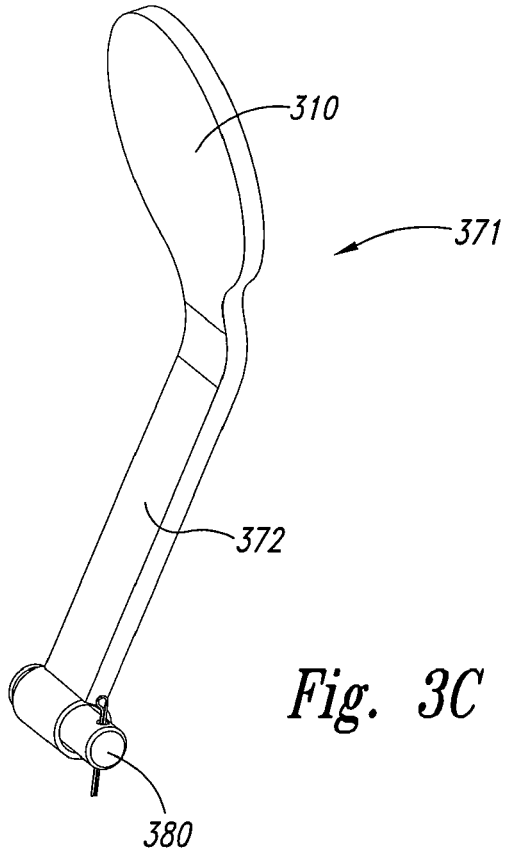
FIG. 3C is an enlarged isometric partial view of a target connector in accordance with an embodiment of the invention.
Figure 3D:
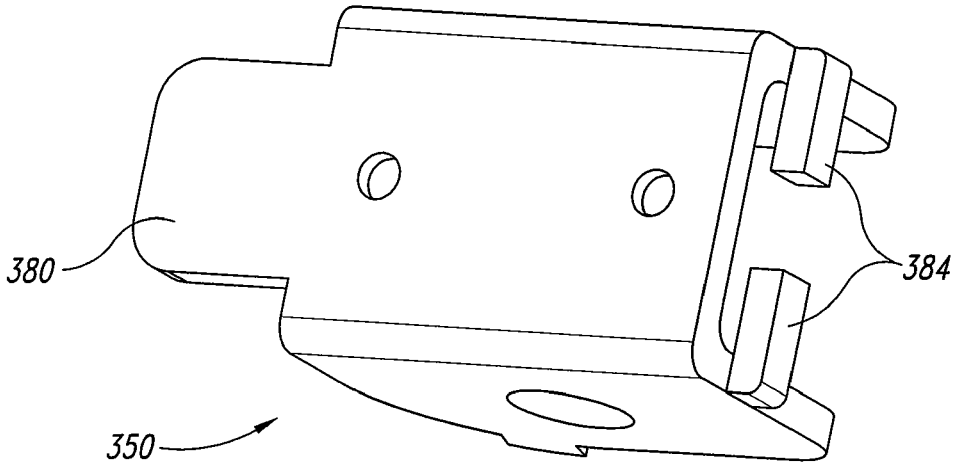
FIG. 3D is an isometric view of an alternative target connector in accordance with an embodiment of the invention.

FIG. 3C is a schematic isometric view of a portion of an assembly 300*a* comprising the target 370 and the target connector 350 in accordance with another embodiment of the invention. Like reference characters refer to like components in FIGS. 3A and 3B and thus the description of such components will not be repeated with reference to the assembly 300*a* illustrated in FIG. 3C. The assembly 300*a* includes a retaining device such as a first protrusion 362 on the sleeve 340 of the target 370. The first protrusion 362 is positioned at least proximate to the stop 360 and configured to initially at least partially resist the rotation of the target 370 from the extended position to the fallen position, but not to prevent rotation of the target 370 from the fallen position to the extended position. For example, the first protrusion 362 contacts the stop 360 as the target 370 and sleeve 340 rotate to the fallen position. Accordingly, rotating the first protrusion 362 past the stop 360 to the fallen position requires a sufficiently large initial force, such as the impact force from a projectile, to overcome the resistance of the first protrusion 362. As noted above, the rotational force of a target 370 moving to the fallen position can sometimes cause other targets that have not been struck by a projectile to fall. Accordingly, the first protrusion 362 at least partially retains the targets 370 in the extended position and at least partially prevents other targets 370 not struck by a projectile from rotating to the fallen position from the extended position. FIG. 3D shows an isometric view of an alternative embodiment of a target connector having an integral target connection retaining means 380 for inhibiting but not preventing a target (not shown) from rotating between an extended position and a fallen position. Target connection retaining means 380 may be integral tabs, bracket components, lips or extensions extending from the target connector 350 to engage the protection device 182 (shown in FIG. 2D). FIG. 3D further shows retention tabs 384 for engaging a lower portion of the target (not shown) when the target is in a fallen position.

Figure 4:
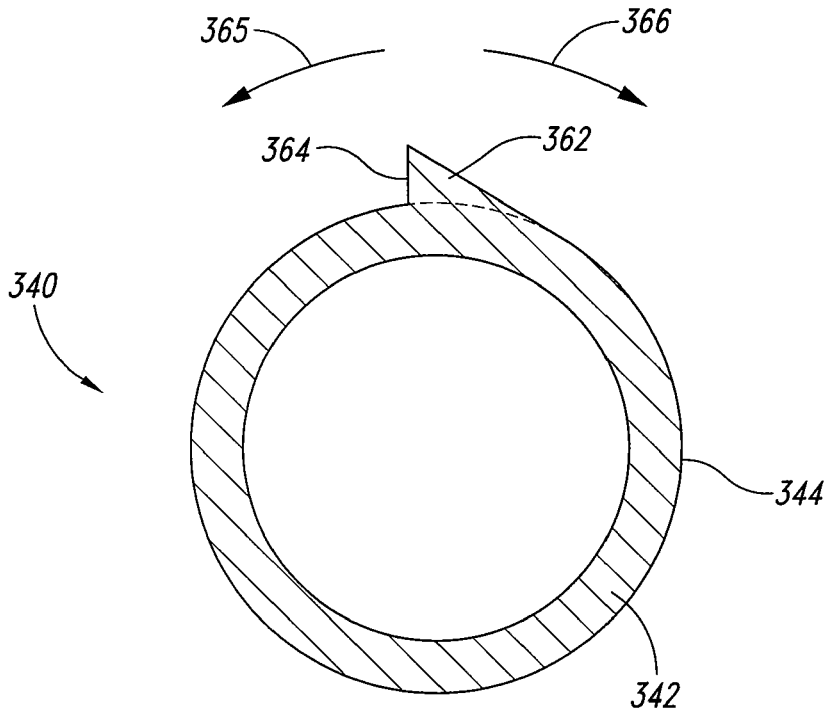
FIG. 4 is a side view of a portion of a target in accordance with an embodiment of the invention.

FIG. 4 is a schematic cross-sectional view of the sleeve 340 of FIG. 3B in accordance with another embodiment of the invention. Referring to FIG. 4, the sleeve 340 includes a circular or annular body 342 with an outer surface 344. In certain embodiments, the first protrusion 362 is positioned on the outer surface 344 of the sleeve 340. The first protrusion 362 has a gradually increasing thickness from the outer surface 344 and a contact surface 364. The first protrusion 362 is configured such that the contact surface 364 contacts the stop 360 to initially and at least partially impede rotation of the sleeve 340 in the direction indicated by the arrow 365, which represents the direction of a target rotating from the extended position to the falling position. Moreover, the configuration of the first protrusion 362, including the gradually increasing thickness, allows the sleeve 340 to more easily rotate in the direction indicated by an arrow 366, which represents the direction of a target rotating from the fallen position to the extended position. Accordingly, the first protrusion 362 can at least partially retain the targets in the extended position and at least partially prevent targets that are not struck with a projectile or other unintended targets from rotating from the extended position to the fallen position. In alternative embodiments, the retaining devices can be a magnet, electromagnetic device or a mechanical rentention means to retain target assemblies against certain forces.

Referring again to FIG. 3B, one embodiment of the assembly 300*a* also includes a second retaining device such as a protrusion 368 on the sidewall 352 of the target connector 350. The second protrusion 368 may be positioned at least proximate to the lower portion 374 of the target 370 and is configured similarly to the first protrusion 362 of the sleeve 340, to initially and at least partially resist the rotation of the target to the fallen position, unless a sufficient impact force, for example from a projectile, is applied to the target head 310. The second protrusion 368 contacts the lower portion 374 of the target 370 as the target 370 rotates, and accordingly at least partially retains the targets in the extended position. In alternative embodiments, the second retaining device can be a magnet, an electromagnetic device or a mechanical retention means to retain target assemblies against certain forces.

Figure 5:
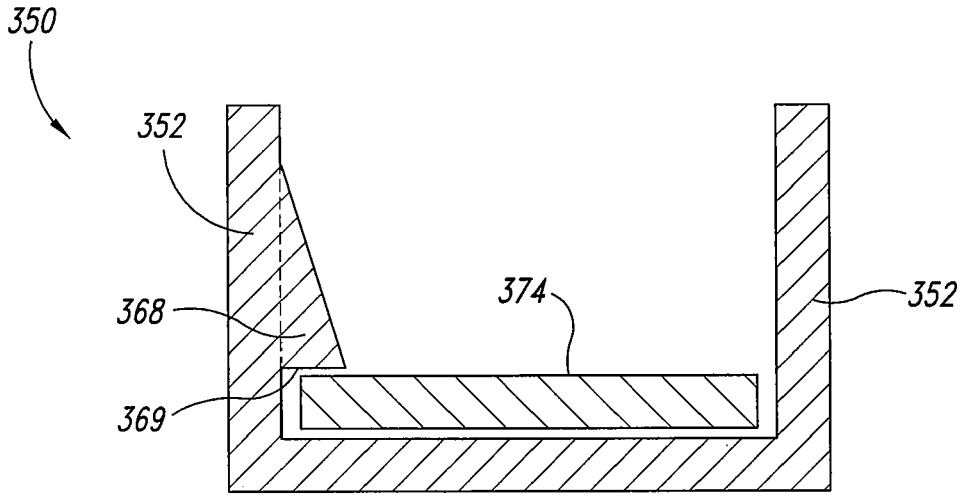
FIG. 5 is a cross-sectional view along line 5-5 of FIG. 3A of a target and target connector in accordance with an embodiment of the invention.

FIG. 5 is a schematic cross-sectional view of the target connector 350 and second protrusion 368 configuration of FIG. 3B in accordance with an embodiment of the invention. Referring to FIG. 5, the lower portion 374 of the target 370 is positioned between the sidewalls 352 of the target connector 350. The second protrusion 368 is positioned on the sidewall 352 and at least proximate to the lower portion 374 of the target 370. The second protrusion 368 has a gradually increasing thickness from the sidewall 352 and also includes a contact surface 369, similar to the first protrusion 362 illustrated in FIG. 4. The second protrusion 368 is configured such that the contact surface 369 contacts the upper surface 376 of the lower portion 374 of the target 370 to initially and at least partially impede rotation of the target 370 from the extended position to the fallen position. Similar to the first protrusion 362, the second protrusion 368 allows the lower portion 374 to more easily rotate past the second protrusion 368 in the direction toward the extended position from the fallen position.

Furthermore, one skilled in the art will appreciate that in certain embodiments the first protrusion 362 and the second protrusion 368 may be combined, while for other embodiments it may be beneficial to employ only one of the protrusions. Accordingly, the second protrusion 368 can at least partially retain the targets in the extended position and at least partially prevent targets that are not struck with a projectile or other unintended targets from rotating from the extended position to the fallen position.

Figure 6:
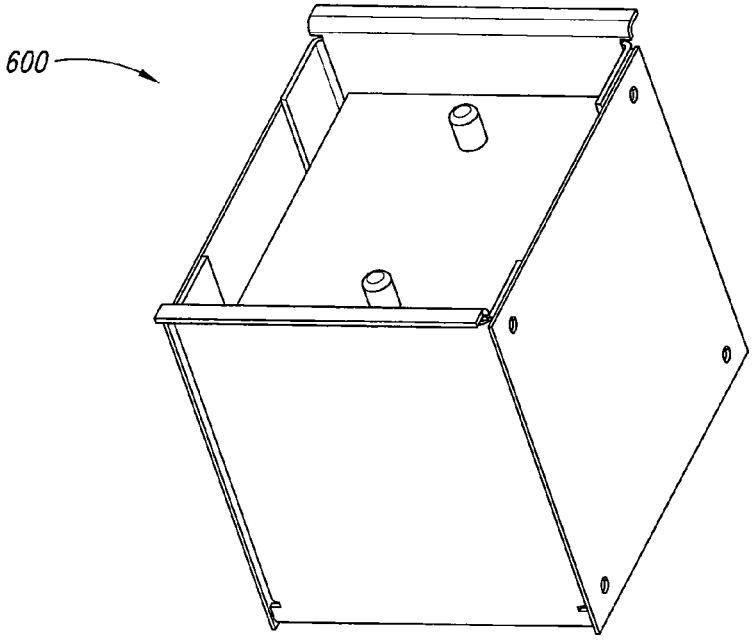
FIG. 6 is an isometric view of a protective housing for use with the shooting gallery in accordance with one embodiment of the invention.
Figure 7:
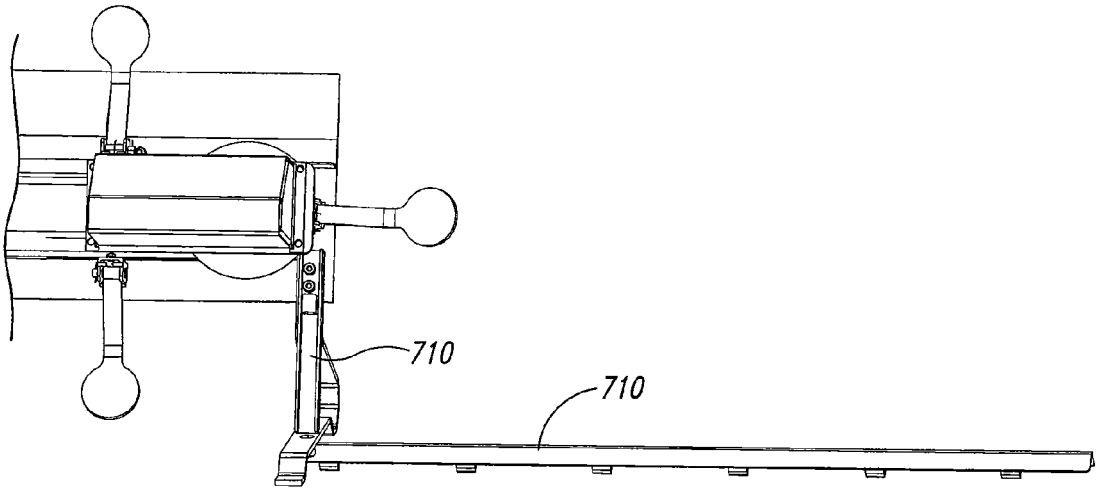
FIG. 7 is a partial isometric view of a power cord protection member of the system in accordance with an embodiment of the invention.

FIG. 6 is an isometric view of a protective housing 600 for use with the shooting gallery. In certain embodiments, wires that connect a battery or remote control are shielded from projectiles with cable shields, shown in FIG. 7. FIG. 7 illustrates power cord protection members 710 adjacent to the power cord (not shown) and positioned to protect the power cord from stray projectiles. The power cord protection members 710 are shown as angles, however, as understood by one skilled in the art, the protection member 710 could be U-shaped, C-shaped, tubular or the like. Furthermore, the protection member 710 can be made of any material suitable to protect the power cord from a projectile.

D. Conclusion

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number, respectively. When the claims use the word "or" in reference to a list of two or more items, that word covers all of the following interpretations of the word: any of the items in the list, all of the items in the list, and any combination of the items in the list.

The above detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform steps in a different order. The various embodiments described herein can be combined to provide further embodiments.

In general, the terms used in the following claims should not be construed to limit the invention to the specific embodiments disclosed in the specification, unless the above detailed description explicitly defines such terms. While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the invention can be modified, if necessary, to employ shooting galleries, targets and target supports with various configurations, and concepts of the various patents, applications, and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all shooting galleries, targets and target supports that operate in accordance with the claims. Accordingly, the invention is not limited by the disclosure, but instead its scope is to be determined entirely by the following claims.

We claim:

1. An automatic shooting gallery, comprising:

a frame;

one or more gears rotatably coupled to the frame;

a power source coupled to the one or more gears;

a conveyor disposed on the one or more gears, wherein the power source drives the conveyor through a loop comprising an active zone and a return zone;

a plurality of target connectors coupled to the conveyor; and a plurality of targets, wherein individual targets comprise a bracket that removably and pivotally couples the targets to the individual target connectors, wherein the targets are configured to rotate between extended and fallen positions and wherein the bracket is configured to at least partially retain the targets in the extended position in the active zone, and the bracket further includes a protrusion for at least partially retaining the targets in the extended position, and wherein the target connectors further comprise a stop that at least partially contacts the protrusion when the targets rotate, wherein the protrusion provides a greater rotational resistance in the direction of rotating from the extended position to the fallen position than in the direction of rotating from the fallen position to the extended position.

2. The shooting gallery of claim 1 wherein the targets further comprise a geometry configured to at least partially rotate the targets from the fallen position to the extended position.

3. The shooting gallery of claim 1 wherein the targets comprise different shapes.

4. The shooting gallery of claim 1, further comprising a remote control, wherein the remote control is configured to control a variable speed of the conveyor.

5. The shooting gallery of claim 4 wherein the remote control is wireless.

6. The shooting gallery of claim 1 wherein the targets are removable without the use of a tool.

7. The shooting gallery of claim 1, further comprising an adjustable conveyor tensioning device.

8. The shooting gallery of claim 1 wherein the power source is configured to drive the conveyor at different speeds.

9. The shooting gallery of claim 1, further comprising a conveyor guide positioned proximate to the conveyor, wherein the conveyor guide at least partially maintains the conveyor on the predetermined path when the target connectors move from the extended position to the fallen position.

10. The shooting gallery of claim 1 wherein a geometry of the target connectors distributes a target weight such that the target weight at least partially retains the targets in the extended position.

11. The shooting gallery of claim 1 wherein the shooting gallery is sized to allow a user to hand carry the gallery.

* * * * *

UNITED STATES PATENT AND TRADEMARK OFFICE

CERTIFICATE OF CORRECTION

PATENT NO. : 7,681,886 B2
APPLICATION NO. : 11/679136
DATED : March 23, 2010
INVENTOR(S) : Morrow et al.

It is certified that error appears in the above-identified patent and that said Letters Patent is hereby corrected as shown below:

Title Page; item (56)
On page 6, in column 1, under "Other Publications", line 30, delete "Hornad" and insert -- Hornady --, therefor.

On page 6, in column 1, under "Other Publications", line 39, delete "Mesure" and insert -- Measure --, therefor.

On page 6, in column 1, under "Other Publications", line 66, delete "accesed" and insert -- accessed --, therefor.

On page 6, in column 2, under "Other Publications", line 30, delete "Iinks/Iink." and insert -- links/link. --, therefor.

On page 7, in column 1, under "Other Publications", line 57, delete ".htrnl," and insert -- .html, --, therefor.

On page 7, in column 1, under "Other Publications", line 60, delete "1tem" and insert -- Item --, therefor.

On page 7, in column 1, under "Other Publications", line 63, delete "wwvv." and insert -- www. --, therefor.

On page 7, in column 1, under "Other Publications", line 64, delete "page" and insert -- pages --, therefor.

On page 7, in column 1, under "Other Publications", line 70, delete "page" and insert -- pages --, therefor.

On page 7, in column 2, under "Other Publications", line 55, delete "pagees." and insert -- pages. --, therefor, Signed and Sealed this Third Day of August, 2010

David J. Kappos

David J. Kappos
*Director of the United States Patent and Trademark Office*

In column 4, line 9, delete “removeably” and insert -- removably --, therefor.

In column 4, line 41, delete “214.to” and insert -- 214 to --, therefor.

In column 5, line 47, delete “slideably” and insert -- slidably --, therefor.

In column 5, line 49, delete “rentention” and insert -- retention --, therefor.

In column 8, line 32, delete “rentention” and insert -- retention --, therefor.